US005407200A

United States Patent [19]

Zalabak

[11] Patent Number: 5,407,200

[45] Date of Patent: Apr. 18, 1995

[54] LOTTERY-TYPE GAMING SYSTEM HAVING MULTIPLE PLAYING LEVELS

[75] Inventor: James M. Zalabak, Bolingbrook, Ill.

[73] Assignee: Douglas Press, Inc., Bellwood, Ill.

[21] Appl. No.: 196,954

[22] Filed: Feb. 15, 1994

[51] Int. Cl.[6] ..... A63F 3/06; B42D 15/00

[52] U.S. Cl. ..... 273/139; 283/901; 283/903

[58] Field of Search ..... 273/139, 138 R, 269; 283/903, 901, 105, 103, 102, 101, 100, 98

[56] References Cited

U.S. PATENT DOCUMENTS

| | | | |
|---|---|---|---|
| 5,046,737 | 9/1991 | Fienberg | 273/139 |
| 5,092,598 | 3/1992 | Kamille | 273/139 |
| 5,158,293 | 10/1992 | Mullins | 273/139 |
| 5,193,815 | 3/1993 | Pollard | 273/139 |

OTHER PUBLICATIONS

Product Brochure, "Bank 200/250", Break Open Games, 2 pages, 1989.

Product Brochure, "Bankers Club", Break Open Games, 2 pages, 1987.

Product Brochure, "Double Zero's", Break Open Games, 2 pages, 1987.

Product Brochure, "Winner's Club TM", Game, 2 pages, 1987.

Product Brochure, "Seal Card Games", 4 pages, 1987.

*Primary Examiner*—Vincent Millin

*Assistant Examiner*—William M. Pierce

*Attorney, Agent, or Firm*—Dick and Harris

[57] ABSTRACT

A lottery-type gaming system having multiple levels of play. The gaming system includes a plurality of playing cards and a master game card. Each of the playing cards includes at least one game symbol displayed thereon. Game symbols which are winning game symbols are displayed upon at least one of the playing cards. The master game card includes a plurality of playing levels. Each playing level includes at least one winning game symbol. At least one winning game symbol present in a first playing level is absent from successive playing levels. Each successive playing level includes a winning game symbol present in each previous playing level.

20 Claims, 1 Drawing Sheet

LOTTERY-TYPE GAMING SYSTEM HAVING MULTIPLE PLAYING LEVELS

BACKGROUND OF THE INVENTION

The present invention relates to gaming systems, and, more particularly, to a lottery-type gaming system having multiple levels of play.

Lottery-type games of chance have exhibited enduring popularity, since such games typically permit a player to make a relatively small "investment" with a chance of winning a significantly larger award. In addition to the entertainment value that such games provide for the players, these types of games typically provide a source of revenue for the operator, be it a municipality, a charity, or business establishment.

As will be appreciated, the entertainment and fun which these types of games of chance provide can be enhanced by affording a player the opportunity of several levels of play. One such type of multiple-level gaming system is described in U.S. Pat. No. 5,046,737. By affording a player the opportunity to advance along successive levels of play, with the value of prizes either collectively or individually increasing with each level, player interest in the game, and in turn, the potential revenues generated from the sale of game cards to such players, is enhanced.

The present invention addresses a different game with several levels of play—and in which selected players become eligible for increasing levels of play, with fewer and fewer players remaining eligible as the level of play increases. These and other objects and features of the present invention will become apparent in view of the present specification, drawings and claims.

SUMMARY OF THE INVENTION

The present invention comprises a gaming system providing multiple levels of play. The gaming system includes a plurality of playing cards. Each of the playing cards includes at least one game symbol displayed thereon. Game symbols which are winning game symbols are displayed upon at least one of the playing cards. A master game card, used in conjunction with the playing cards, includes a plurality of playing levels. The plurality of playing levels includes a first playing level and at least one successive playing level. Each successive playing level has at least one previous playing level. Each of the playing levels includes at least one award identifying means. The award identifying means identifies both an award and at least one winning game symbol associated with the identified award.

The first playing level includes at least two award identifying means. Each of the successive playing levels includes at least one identifying means which includes a winning game symbol present in each of the previous playing levels. At least one of the award identifying means of the first playing levels includes a winning game symbol which is absent from the award identifying means of at least one successive playing level.

At least one of the playing cards further includes means for initially concealing the at least one game symbol displayed upon the card. The game symbol concealing means includes a repositionable flap-like member. Similarly, the award identifying means includes means for initially concealing the at least one corresponding winning game symbol. The winning game symbol concealing means includes a repositionable flap-like member. The award of the award identifying means is integrally associated with the winning game symbol concealing means.

The gaming system further includes means for identifying holders of playing cards which include at least one game symbol eligible to be a winning game symbol identified by the master game card. In the illustrated embodiment, the holder identifying means comprises a list of eligible game symbols and a plurality of name regions. Each name region, associated with an eligible game symbol within the list, allows the recordation of indicia identifying a holder of a playing card bearing the associated eligible game symbol. The holder identifying means is integrally associated with the master game card.

In the illustrated embodiment, the plurality of playing levels comprises four playing levels; the first playing level, a second playing level, a third playing level, and a fourth playing level. The first playing level includes four award identifying means. The second playing level includes three award identifying means. The third playing level includes two award identifying means. The fourth playing level includes one award identifying means. Accordingly, although each successive playing level may include at least one fewer award identifying means than the respective immediately previous playing level, in the illustrated embodiment, each successive playing level includes exactly one fewer award identifying means than the respective immediately previous playing level.

Also in the illustrated embodiment, each award identifying means of a respective playing level includes a winning game symbol which is different from the winning game symbols of the other award identifying means within the same playing level. Each of the award identifying means of a respective successive playing level includes a winning game symbol which is present in the immediately previous playing level. Within any of the plurality of playing levels, all of the awards of all of the award identifying means are equal to one another. Each of the award identifying means within each successive playing level includes an award which is greater than any of the awards of each of the award identifying means within the respective immediately previous playing level.

Moreover, within the illustrated embodiment, at least one of the awards comprises a monetary value. At least a portion of the game symbols comprise numeric designations. Further, at least one game symbol of at least one playing card may be an instant-winning game symbol. At least one of the playing cards further includes indicia which indicates a plurality of classes of winning game symbols. This indicia indicates whether an individual game symbol is within a class of instant-winning game symbols, or is within a class of game symbols which is eligible to be a winning game symbol identified by the master game card.

The present gaming system is particularly well suited for fundraising activities. The removal of at least one award identifying means present in the first level of play from at least one successive level of play, combined with the presence of at least one individual winning game symbol within each playing level, serves to increase excitement in playing the present gaming system.

DETAILED DESCRIPTION OF THE DRAWINGS

Figure 1:
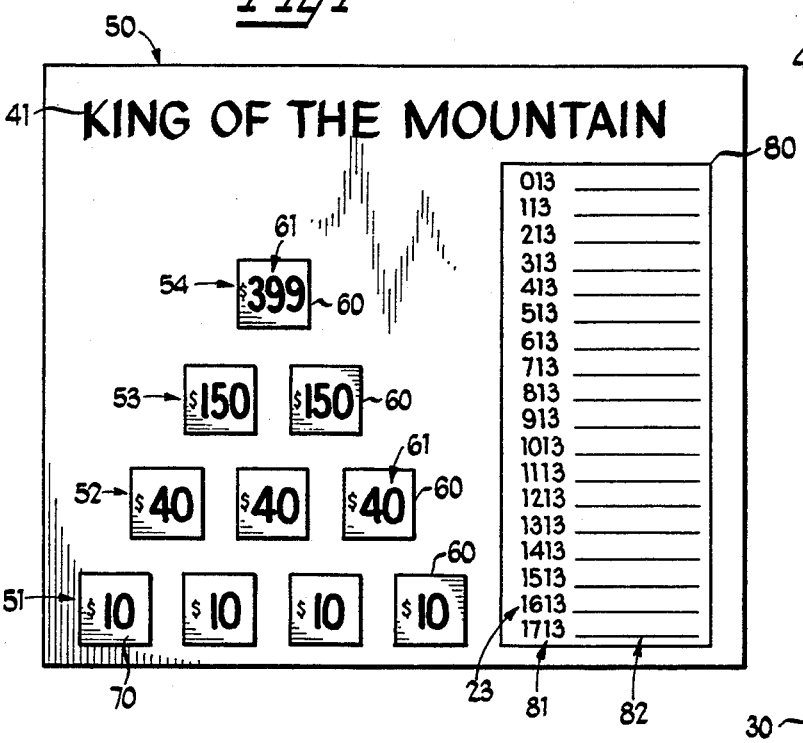
FIG. 1 of the drawings is a top plan view of the master game card, showing, in particular, the plurality of playing levels and the holder identifying means.
Figure 3:
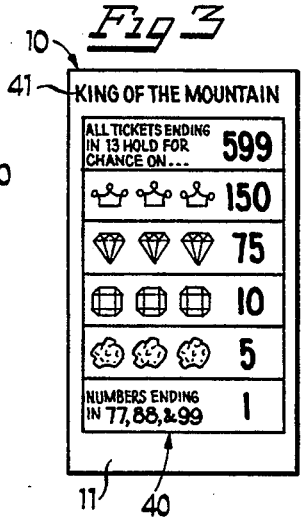
FIG. 3 of the drawings is a top plan view of the payout side of a playing card, showing, in particular, the indicia indicating a plurality of classes of winning game symbols.
Figure 4:
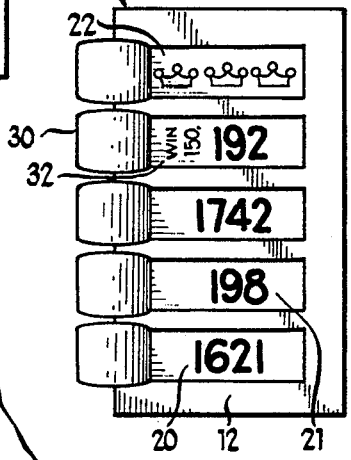
FIG. 4 of the drawings is a top plan view showing a portion of the tab side of a playing card, showing, also, the game symbols displayed on the game image area of the playing card.

While this invention is susceptible of embodiment in many different forms, there is shown in the drawings and will herein be described in detail, one specific embodiment with the understanding that the present disclosure is to be considered as an exemplification of the principles of the invention and is not intended to limit the invention to the embodiment illustrated.

The present gaming system is shown in FIGS. 1 through 5 as comprising a plurality of playing cards 10 and a master game card 50. Playing card 10 includes a payout side 11 (shown in FIG. 3) and an "open-here" or tab side 12 (shown in FIGS. 4 and 5). Tab side 12 of playing card 10 includes a plurality of game symbols 20. Game symbols 20 may comprise numeric designations, such as game symbol 21, or graphic designations, such as game symbol 22.

Tab side 11 of playing card 10 includes indicia 40 indicating a plurality of classes of winning game symbols. Specifically, indicia 40 indicates whether an individual game symbol is within a class of instant-winning game symbols, or is within a class of game symbols eligible to be a winning game symbol identified by master game card 50. In the illustrated embodiment, indicia 40 indicates that game symbols comprising numeric designations with ending digits equal to "77" "88" or "99" are instant-winning game symbols, entitling the holder of a card bearing such a winning game symbol to a $1.00 award. Similarly, game symbols which comprise graphic representations of three "gold nuggets", three "gems", three "diamonds", or three "crowns", are also instant-winning game symbols, entitling the holders of cards bearing these game symbols to awards of $5.00, $10.00, $75.00, and $150.00, respectively. Of course, other instant-winning symbol combinations may be so designated.

Indicia 40 further indicates that game symbols which comprise numeric designations with ending digits equal to "13" are game symbols which are eligible to be winning game symbols identified by master game card 50, potentially entitled to an award of up to $599.00.

Tab side 12 of playing card 10 further includes game symbol concealing means for initially concealing the game symbols 20 displayed upon the playing card. In the illustrated embodiment, the game symbol concealing means comprises a repositionable flap-like member 30. When playing cards are initially distributed to players of the present gaming system, all of the flap-like members are in a closed position, covering the associated game symbols, as shown for the topmost two game symbols of FIG. 5. The players of the present gaming system, i.e., holders of playing cards 10, open each of the flap-like members 30 in order to reveal the game symbols displayed beneath. The flap-like members 30 further include indicia 31, encouraging holders of playing cards 10 to open, or reposition, the game symbol concealing means.

In the illustrated embodiment, the playing cards 10 have a 2-ply construction. A first ply bears the game symbols. A second ply, attached to the first ply, includes substantially rectangular regions, frangible on three sides, which comprise the flap-like members 30 and thus provides the game symbol concealing means. Although, in the illustrated embodiment, game symbol concealing means 30 are achieved through the use of a 2-ply playing card construction, game symbol concealing means 30 may have numerous alternative configurations. For example, playing card 10 may comprise only a single ply construction, with the game symbol concealing means comprising a flap-like member affixed to playing card 10 along one side of the flap-like member. Alternatively, game symbol concealing means 30 may comprise a removable opaque substance, such as conventionally known "scratch-off" material. Moreover, although in the illustrated embodiment each of the game symbols 20 displayed upon playing card 10 are associated with an individual game symbol concealing means, it is also contemplated that a single game symbol concealing means may be employed to conceal a plurality of game symbols.

Figure 2:
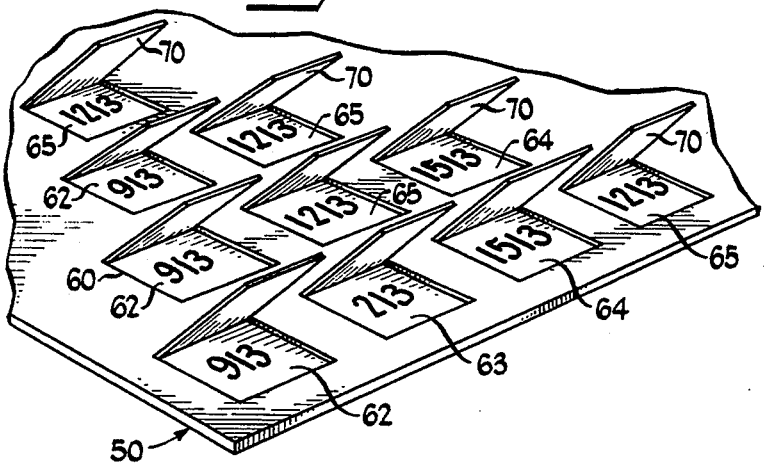
FIG. 2 of the drawings is an enlarged, fragmentary view of a portion of the master game card, showing, in particular, the winning game symbols.
Figure 5:
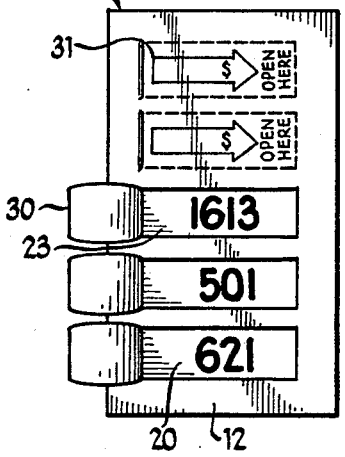
FIG. 5 of the drawings is a top plan view showing a portion of the tab side of a playing card, showing, in particular, the repositionable flap-like members.

Master game card 50 is shown in FIGS. 1 and 2 as including a plurality of playing levels. In the illustrated embodiment, master game card 50 includes four playing levels; a first playing level 51, a second playing level 52, a third playing level 53 and a fourth playing level 54. At least one award identifying means 60 is associated with each playing level. Each award identifying means 60 identifies both an award 61 and at least one winning game symbol associated with the award. In the illustrated embodiment, there are four unique winning game symbols having numeric designations, as shown in FIG. 2; winning game symbol 62 having the numeric designation "913", winning game symbol 63 having the numeric designation "213", winning game symbol 64 having the numeric designation "1513", and winning game symbol 65 having the numeric designation "1213".

All four winning game symbols are present within first playing level 51. Each successive playing level contains one fewer winning game symbol than its respective immediately previous playing level. Accordingly, one winning game symbol, and in turn, the holder of the playing card 10 bearing the winning game symbol, is "eliminated" from receiving future awards as the level of play increases. As shown in FIG. 2, winning game symbol 63, having the numeric designation "213" is absent from second playing level 52, third playing level 53 and fourth playing level 54. Similarly, winning game symbol 64 having the numeric designation "1513" is absent from third playing level 53 and from fourth playing level 54. Winning game symbol 62 having the numeric designation "913" is absent from fourth playing level 54.

In the illustrated embodiment, the awards 61 associated with all of the award identifying means within any playing level are equal to one another. Moreover, the awards 61 associated with the winning game symbols of a respective playing level increases as the level of play increases. Winning game symbols present within first playing level 51 are each associated with a $10.00 award; winning game symbols present within second playing level 52 are each associated with a $40.00 award; winning game symbols present within third playing level 53 are each associated with a $150.00; and the winning game symbol present in fourth playing level 54 is associated with a $399.00 award.

The holder of a winning game symbol receives the aggregate of the awards 61 associated with each playing level in which the winning game symbol appears. For example, since the winning game symbol having the numeric designation "213" is present only within first playing level 51, the holder of the playing card displaying winning game symbol 63 receives a $10.00 award. Since winning game symbol 65 having the numeric designation "1213" is present within all four playing levels of master game card 50, the holder of playing card 10 displaying winning game symbol 65 receives $599.00; $10.00 plus $40.00 plus $150.00 plus $399.00.

Master game card 50 further includes winning game symbols concealing means for initially concealing the winning game symbols 20 displayed upon the master game card. In the illustrated embodiment, the winning game symbol concealing means comprises a repositionable flap-like member 70. Initially, all flap-like members 70 are in a closed position, covering the associated winning game symbols, as shown in FIG. 1. Once playing cards 10 have been distributed, each of the flap-like members 70 is opened or repositioned in order to reveal game symbols displayed beneath. In the illustrated embodiment, awards 61 comprise indicia displayed upon flap-like members 70.

In the illustrated embodiment, master game card 50 has a 2-ply construction. A first ply bears the winning game symbols. A second ply, attached to the first ply, includes substantially rectangular regions, frangible on three sides, which comprise the flap-like members 70 and thus provide the winning game symbol concealing means. Although, in the illustrated embodiment, winning game symbol concealing means are achieved through the use of a 2-ply master game card construction, the winning game symbol concealing means may have numerous alternative configurations. For example, master game card 50 may comprise only a single ply construction, with the winning game symbol concealing means comprising a flap-like member affixed to master game card 50 along one side of the flap-like member. Alternatively, the winning game symbol concealing means may comprise a removable opaque substance, such as conventionally known "scratch-off" material. Moreover, although in the illustrated embodiment each of the winning game symbols displayed upon master game card 50 is associated with an individual winning game symbol concealing means, it is also contemplated that an individual winning game symbol concealing means may be employed to conceal a plurality of game symbols. For example, a single winning game symbol concealing means may be employed to initially conceal all of the winning game symbols within a single playing level.

The present gaming system further includes holder identifying means 80 for identifying holders of playing cards which include at least one game symbol which is eligible to be a winning game symbol identified by master game card 50. Holder identifying means 80 includes a list of eligible game symbols 81 and a plurality of name regions 82. List of eligible game symbols 81 includes game symbols which may potentially be displayed as winning game symbols upon master game card 50, upon the removal or repositioning of the winning game symbol concealing means. For example, playing card 10 of FIG. 5 includes game symbol 23 having the numeric designation "1613." Inasmuch as game symbol 23 is also within list 81, game symbol 23 is an eligible game symbol. The holder of playing card 10 bearing game symbol 23 is thus eligible to win an award indicated by master game card 50.

In the illustrated embodiment, the list of eligible game symbols 81 contains more game symbol designations than the four winning game symbols actually displayed upon master game card 50. In particular, 18 game symbols, all ending in the numerals "13", are contained within list 81 and are thus identified as being eligible game symbols. Associated with each eligible game symbol of list 81 is a name region 82. Each name region 82 provides space for the recordation of the name, or other indicia, which identifies the holder of a playing card 10 which displays the associated eligible game symbol.

In the illustrated embodiment, both playing card 10 and master game card 50 further include indicia 41 identifying a particular name assigned the present game system, and identifying the association between a particular playing card 10 and master game card 50.

In operation, the plurality of playing cards 10 are distributed to players of the present gaming system, who become holders of the playing cards. If the present gaming system is being employed for fundraising purposes, each player will purchase one or more playing cards for a predetermined price. The holders of the playing cards reposition or remove the game symbol concealing means to reveal the game symbols 20 displayed upon the playing card. Holders of cards displaying instant-winning game symbols, such as instant winning game symbol 22 of FIG. 4, receive the awards designated within indicia 40. In the illustrated embodiment, playing card 20 further includes indicia 32 indicating the total instant-winning awards won by the holder of a given playing card. This indicia 32 serves to reduce errors in determining the total award payable to a playing card holder.

The names of the holders of playing cards displaying eligible winning game symbols, which, in the illustrated embodiment, are game symbols ending in the numeric designation "13" are recorded within holder identifying means 80. Specifically, the name of each holder is recorded within the name region 82 corresponding to the eligible winning game symbol 81 displayed upon the respective holder's playing card.

Once all of the names of the holders of playing cards displaying eligible game symbols have been recorded, the winning game symbol concealing means 70 are selectively removed or repositioned. First, all repositional flap-like members 70 within first playing level 51 are raised to reveal winning game symbols 62, 63, 64 and 65. The holders of game cards displaying any of these winning game symbols each receive a $10.00 award.

Next, repositionable flap-like members 70 of second playing level 52 are raised to reveal winning game symbols 62, 65 and 64. The holder of playing card 10 displaying winning game symbol 63 is "eliminated" from further play, and holders of game cards displaying winning game symbols 62, 65 and 64 each receive an additional $40.00 award.

Next, flap-like members 70 of third playing level 53 are raised to reveal winning game symbols 62 and 65. The holders of game cards displaying winning game symbols 62 and 65 each receive an additional $150.00 award, and the holder of the playing card displaying winning game symbol 64 is "eliminated" from further play.

Finally, flap-like member 70 of fourth playing level 54 is raised to reveal winning game symbol 65, and the holder of the playing card displaying this winning game symbol receives an additional $399.00 award.

This sequential revealment of winning game symbols by playing level, along with the removal of winning game symbols, and the corresponding elimination of holders of playing cards displaying winning game symbols, as the level of play progresses, serves to increase the enjoyment and excitement of players of the present game system.

The foregoing description and drawings merely explain and illustrate the invention and the invention is not limited thereto except insofar as the appended claims are so limited, as those skilled in the art who have the disclosure before them will be able to make modifications and variations therein without departing from the scope of the invention.

What is claimed is:

1. A gaming system apparatus providing multiple levels of play, comprising:

a plurality of playing cards, each of the playing cards including at least one game symbol displayed thereon;

at least one of said playing cards displaying a winning game symbol;

a master game card for use in conjunction with the plurality of playing cards, the master game card including a plurality of playing areas representing a plurality of playing levels;

the plurality of playing areas including a first playing area representing a first playing level and at least one successive area representing an additional playing level;

each successive playing area having at least one previous playing area representing a previous level of play;

each of the playing areas including indicia having at least one award identifying means for identifying both an award and at least one said winning game symbol associated with said identified award;

the first playing area including indicia having at least two award identifying means collectively having at least two different winning game symbols;

each of the successive playing areas including indicia having at least one award identifying means which includes a winning game symbol of a same type present in each of the previous playing areas; and at least one of the award identifying means of the first playing area including a winning game symbol absent from the award identifying means of at least one successive playing area.

2. The invention according to claim 1 wherein the award identifying means further includes means for initially concealing the at least one corresponding winning game symbol.

3. The invention according to claim 2 wherein the winning game symbol concealing means includes a repositionable flap-like member.

4. The invention according to claim 2 wherein the award of the award identifying means is positioned on the winning game symbol concealing means.

5. The invention according to claim 1 wherein at least one of the playing cards further includes means for initially concealing the at least one game symbol displayed thereon.

6. The invention according to claim 5 wherein the game symbol concealing means includes a repositionable flap-like member.

7. The invention according to claim 1 wherein each successive playing area includes indicia having at least one fewer award identifying means than the respective immediately previous playing area.

8. The invention according to claim 7 wherein each successive playing area includes indicia having exactly one fewer award identifying means than the respective immediately previous playing area.

9. The invention according to claim 1 wherein each award identifying means of a respective playing area includes a winning game symbol different from the winning game symbols of other award identifying means within the same playing area.

10. The invention according to claim 1 wherein each of the award identifying means of a respective successive playing area includes a winning game symbol present in the immediately previous playing area.

11. The invention according to claim 1, wherein the plurality of playing areas comprises four playing areas:

the four playing areas including said first playing area, a second playing area, a third playing area, and a fourth playing area;

the first playing area including indicia having four award identifying means;

the second playing area including indicia having three award identifying means;

the third playing area including indicia having two award identifying means; and the fourth playing area including indicia having one award identifying means.

12. The invention according to claim 1 wherein all of the awards of all of the award identifying means within any of said plurality of playing areas are equal to one another.

13. The invention according to claim 1 wherein each of the award identifying means within each successive playing area includes an award which is greater in value than any of the awards of each of the award identifying means within the respective immediately previous playing area.

14. The invention according to claim 1 wherein at least one of the awards comprises a monetary value.

15. The invention according to claim 1 wherein at least a portion of the game symbols comprise numeric designations.

16. The invention according to claim 1 wherein at least one game symbol of at least one playing card comprises indicia identifying the game symbol as being an instant winning game symbol.

17. The invention according to claim 16 wherein at least one of the playing cards further includes indicia indicating a plurality of classes of winning game symbols, the classes of winning game symbols including a class of instant-winning game symbols and a class of game symbols eligible to be a winning game symbol, the indicia indicating whether an individual game symbol is an instant winning game symbol or is a game symbol eligible to be a winning game symbol.

18. The invention according to claim 1 wherein the gaming system further includes means for identifying holders of playing cards which include at least one game symbol eligible to be a winning game symbol.

19. The invention according to claim 18 wherein the holder identifying means comprises a list of eligible game symbols and a plurality of name regions, each name region associated with an eligible game symbol within the list, each name region allowing the recordation of indicia identifying a holder of a playing card bearing the associated eligible game symbol.

20. The invention according to claim 18 wherein the holder identifying means is positioned on the master game card.

* * * * *